US006541686B2

(12) United States Patent
O'Donnell

(10) Patent No.: US 6,541,686 B2
(45) Date of Patent: Apr. 1, 2003

(54) SWING ACTION DOUBLE BEATER PERCUSSION PEDAL

(76) Inventor: Richard L. O'Donnell, 142 Willow Brook, St. Louis, MO (US) 63146

( * ) Notice: Subject to any disclaimer, the term of this patent is extended or adjusted under 35 U.S.C. 154(b) by 0 days.

(21) Appl. No.: 09/788,213

(22) Filed: Feb. 16, 2001

(65) Prior Publication Data

US 2002/0152872 A1 Oct. 24, 2002

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS 1,042,904 A * 10/1912 Fraser ..... 84/422.2
1,508,390 A 9/1924 Gladstone et al.
2,446,508 A * 8/1948 Crowell ..... 84/422.1
2,484,302 A 10/1949 Laverents
3,618,441 A 11/1971 Fearns
3,677,128 A 7/1972 Simpson
3,988,957 A 11/1976 Escamilla
4,188,853 A 2/1980 Bills
4,235,146 A 11/1980 Purdy
4,644,842 A 2/1987 Aluisi
4,782,733 A 11/1988 Herring
4,945,803 A 8/1990 Norwood
5,090,289 A 2/1992 Holcomb
5,767,428 A 6/1998 Bloch

* cited by examiner

*Primary Examiner*—Shih-Yung Hsieh
(74) *Attorney, Agent, or Firm*—Polster, Lieder, Woodruff & Lucchesi, L.C.

(57) ABSTRACT

The present invention relates to an apparatus for striking a percussion instrument with one or more percussion beaters utilizing a swing motion of the user's foot, and more particularly, to an apparatus for striking the head of a bass drum or other percussion instrument multiple times with one or more percussion beaters upon a single swing cycle by the user utilizing a single foot.

11 Claims, 4 Drawing Sheets

SWING ACTION DOUBLE BEATER PERCUSSION PEDAL

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

In a typical pedal design beater, a base plate is attached at one end to a percussion instrument, typically a bass drum, and a footboard is hinged to the base plate at or near the opposite end. The footboard rotates about the hinge and is constrained by springs or other means to rest in a position approximately 30 to 45 degrees above the base. The footboard is attached to a beater such that when the user presses down on the footboard, the beater strikes the drumhead once. The footboard must return essentially to its resting position in order for the user to strike the drumhead again.

This mechanism provides a steady, controllable, sensitive means of playing percussion instruments. However, playing speed is limited to the speed that the user can press the pedal since only one beat can be produced for each depression of the pedal. No beats are produced when the musician lifts his foot from the pedal. Thus for each up and down movement of the musician's foot, only one drum beat can be produced. This has the effect of limiting the role of the foot to that of a timekeeper, playing only the tempo of the music. In some more sophisticated configurations, the pedal beater may play offbeat patterns combined with the hands, but will still be unable to execute more than three or four quick strokes at a time. While it is true that a select few players demonstrate considerable speed for several measures using conventional pedal beaters, such players are only able to play a string of even notes in such manner, and never complicated patterns like those played by the hands. A musician may attempt to overcome this limitation by utilizing two foot pedals simultaneously to increase playing speed and obtain more complex beat patterns. However, the musician then sacrifices the use of the cymbal assembly, commonly known in the field as the hi-hat, and such rapid foot motions are both difficult and very tiring.

Several attempts have been made to invent double beater drum pedals. However, all prior attempts have a number of disadvantages which have limited their commercial applications. It is a principal object of the present invention to provide a double beater drum pedal which overcomes these disadvantages.

U.S. Pat. No. 2,484,302 to Lavernts discloses a double beater pedal mechanism in which the foot pedal hinge is placed in a very awkward position compared to pedals in common usage. Additionally, the beater striking positions are in musically undesirable positions because one beater strikes close to the rim, while the other strikes close to the middle of the head, thus producing drastically different timbres and amplitudes.

The pedal assembly shown as U.S Pat. No. 3,988,957 to Escanilla also places the musician's foot in an awkward position. Playing fast heel/toe motions requires either suspending the entire leg to obtain the proper position or relaxing the leg thus causing one beater to rest on the head while the other beater is striking, causing a buzz or muting effect. Also, the pivot point in Escanilla is below the foot, causing the whole lower leg to move.

U.S. Pat. No. 4,188,853 to Bills shows another double beater mechanism with strong disadvantages. The fulcrum is placed below the heel, increasing lower leg movement. While the downward toe stroke is made with a downward motion, the up stroke must be performed with an upward motion of the toe, an action not empowered with strength, control or routine muscular movement. The toe clip also creates a lack of foot position mobility.

The double beater mechanism in U.S. Pat. No. 4,644,842 to Aluisi offers an unmanageable action created by the horizontal pivot which adds much weight to the beater adversely affecting its sensitivity. Much of the striking energy is deflected in rotation, rather than in increased amplitude. Control of the timing accuracy is also sacrificed because of the "flop" rotation of the second beater.

Finally, in U.S. Pat No. 4,782,733 to Herring, the double beater drum mechanism results in poor timing control of the secondary beater because it is spring activated. This same spring activation results in poor amplitude control of the secondary beater. Additionally, maximum speed would be determined by the spring tension activating the secondary beater, rather than the action of the player.

Many of these disadvantages are readily evident to a person knowledgeable in the art of drumming and explains why none of these ideas are implemented in the current commercial market.

SUMMARY OF THE INVENTION

The present invention resides in a foot pedal device with at least two beaters and a footboard attached to the beaters that swings freely above the base of the device. Upon a single back and forth swing cycle of the footboard, both beaters strike a desired percussion instrument at intervals generally reciprocal to one another. Specifically, one beat is produced when the footboard is swung forward, and another drum beat is produced when the footboard is swung backward. This allows the musician to accomplish two percussion beats with a single foot swing cycle, while freeing the musician's other foot to play another percussion instrument such as a hi-hat. This is in contrast to the typical drum pedal design where a foot stroke of one downward and one upward movement of the foot only produces a single beat. The musician can thereby play at twice the speed of a conventional foot pedal beater.

More particularly, the swing motion allows greater control over, and sensitivity to, the timbre, amplitude and tempo of the beats, and enables the musician to perform complex rhythms and beat patterns. The reciprocally striking beaters and the footboard swing motion combine to form a unique pedal operation which is more ergonomic and less fatiguing than a conventional hinged footboard beater system. The present invention therefore allows the musician to perform more sustained and demanding percussion parts, including novel percussion playing concepts such as layered percussion patterns, polyrhythms, "third hand" patterns, and orchestration for two instruments on one foot pedal.

The present invention is readily adaptable to numerous percussion instruments, such as a base drum, two or more cow bells, wood blocks, and bongos.

Additional features of the present invention will be in part apparent and in part pointed out hereinafter.

BRIEF DESCRIPTION OF THE SEVERAL VIEWS OF THE DRAWINGS

In the drawings, wherein like numerals and letters refer to like parts wherever they occur.

Corresponding reference characters indicate corresponding parts throughout the several views of the drawings.

While one embodiment of the present invention is illustrated in the above referenced drawings and in the following description, it is understood that the embodiment shown is merely for purpose of illustration and that various changes in construction may be resorted to in the course of manufacture in order that the invention may be utilized to the best advantage according to circumstances which may arise, without in any way departing from the spirit and intention of the invention, which is to be limited only in accordance with the claims contained herein.

DETAILED DESCRIPTION

Figure 1:
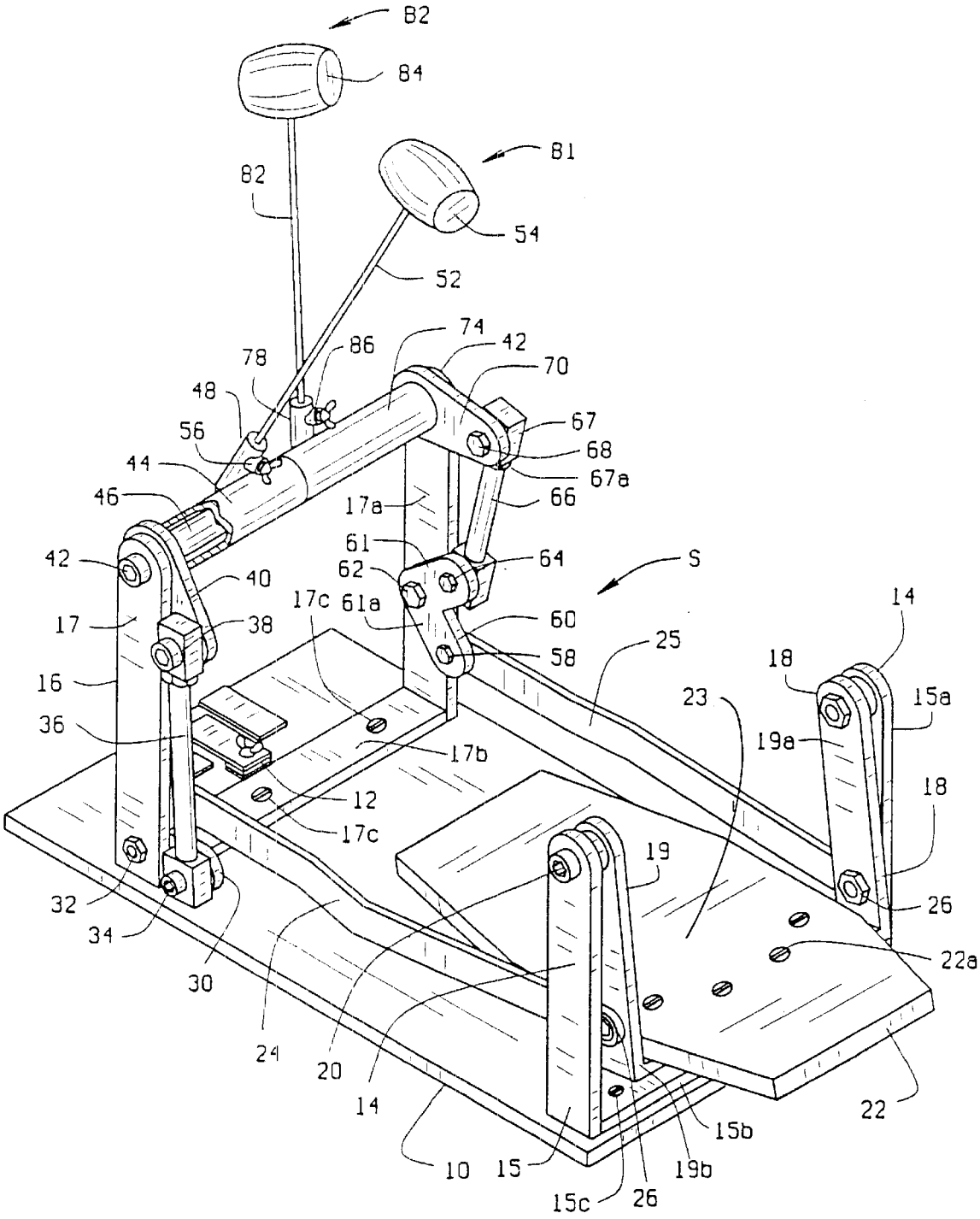
FIG. 1 is a perspective view of the preferred embodiment of the invention.
Figure 2:
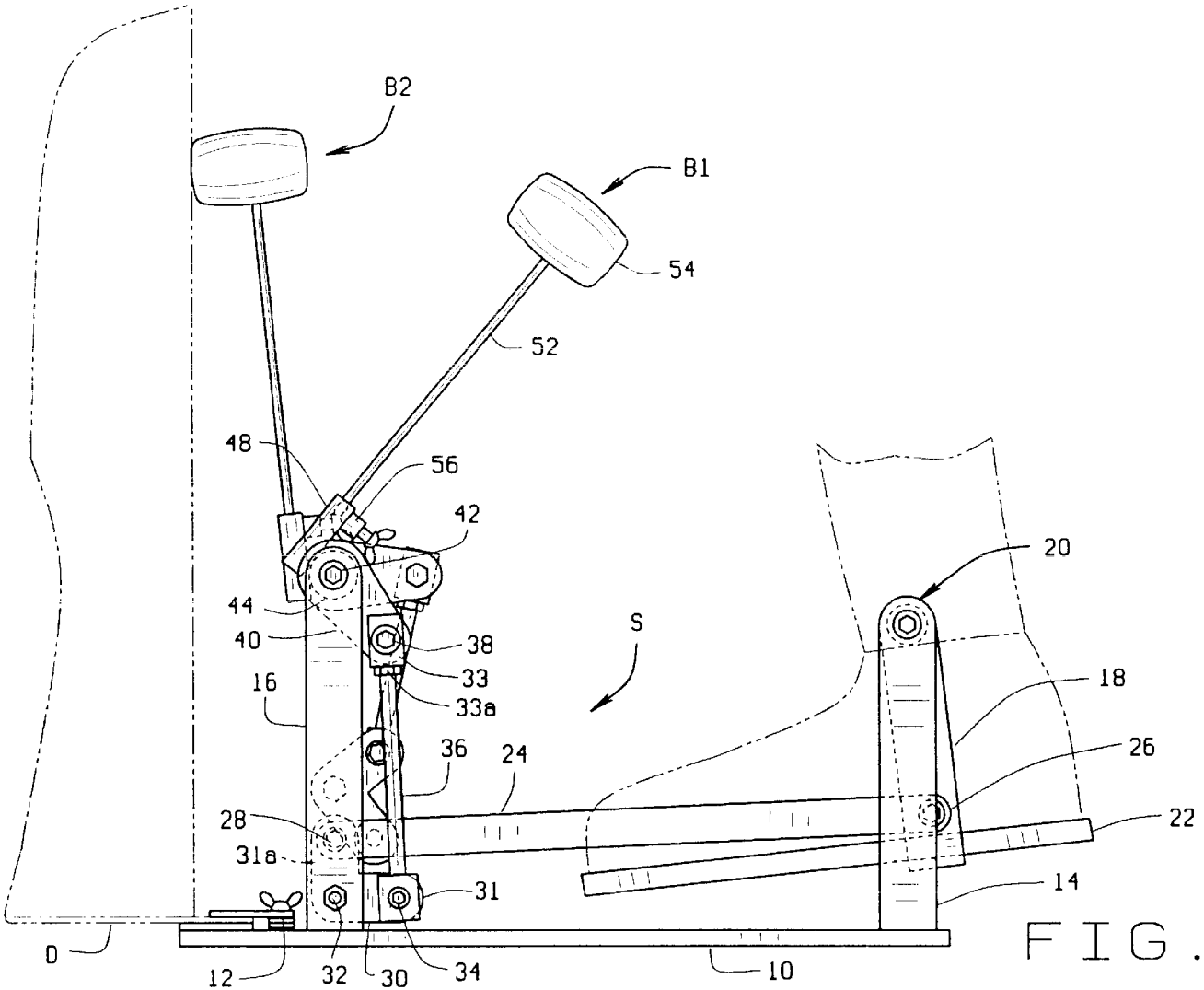
FIG. 2 is a side elevation view of the preferred embodiment showing the foot plate in the rearward rocking position and the right beater striking the drum head.

Referring now to FIGS. 1 and 2, in the preferred embodiment, a swing action double beater percussion device S is mounted on a flat base plate 10 and attached to a percussion instrument such as a bass drum D (shown in broken lines in FIG. 2) by connecting the flat base plate 10 to the drum D with a tension fastener 12, such as the spring-loaded wing-nut and lever assembly shown, located at one end of the base plate 10. The base plate 10 is rectangular, with its short ends nearest to, and furthest from, the bass drum D. The fastener 12 is located adjacent to the end of the base plate 10 nearest to the drum D.

A U-shaped bracket 14, formed from heavy strap metal has upstanding legs 15,15*a* and is removably mounted by machine screws 15*c* through its base 15*b* to the rear of the base plate 10. Another, U-bracket 16, also formed from heavy strap metal and having upstanding legs 17,17*a* also is removably mounted by machine screws 17*c* through its base 17*b* to the base plate 10 near the drum D, but behind the fastener 12. The bases of both U-brackets 14 and 16 lie parallel to the short ends of the base plate 10, and the legs of both U-brackets 14 and 16 extend vertically from the base plate 10. When the screws 15*c*, 17*c*, and 22*a* are removed, the device S can be broken down into a book size package for transport which is important to a musician who often must travel to different venues with his instrument.

A U-bracket or cradle 18, also formed from heavy strap metal and having legs 19, 19*a* and a connecting base 19*b*, is pivotally attached at the top of its arms 19, 19*a* to the top or free ends of the U-bracket legs 15, 15*a* by bolt assemblies 20, such that the cradle 18 may swing freely the between U-bracket legs 15, 15*a* about the bolt assemblies 20. The bracket base 19*b* is flat and the distance between the arms 19, 19*a* readily accommodates an overlarge booted human foot.

A footboard 22, having a generally flat upper surface 23, is rigidly attached by the screws 22*a* atop the base 19*b* of the U-bracket 18, such that the upper surface 23 is parallel to the upper surface of the U-bracket base 19*b*. Approximately two-thirds of the length of the footboard 22 is positioned forward of U-bracket 18, and the forward edge or toe of the footboard 22 faces toward the drum D.

Figure 4:
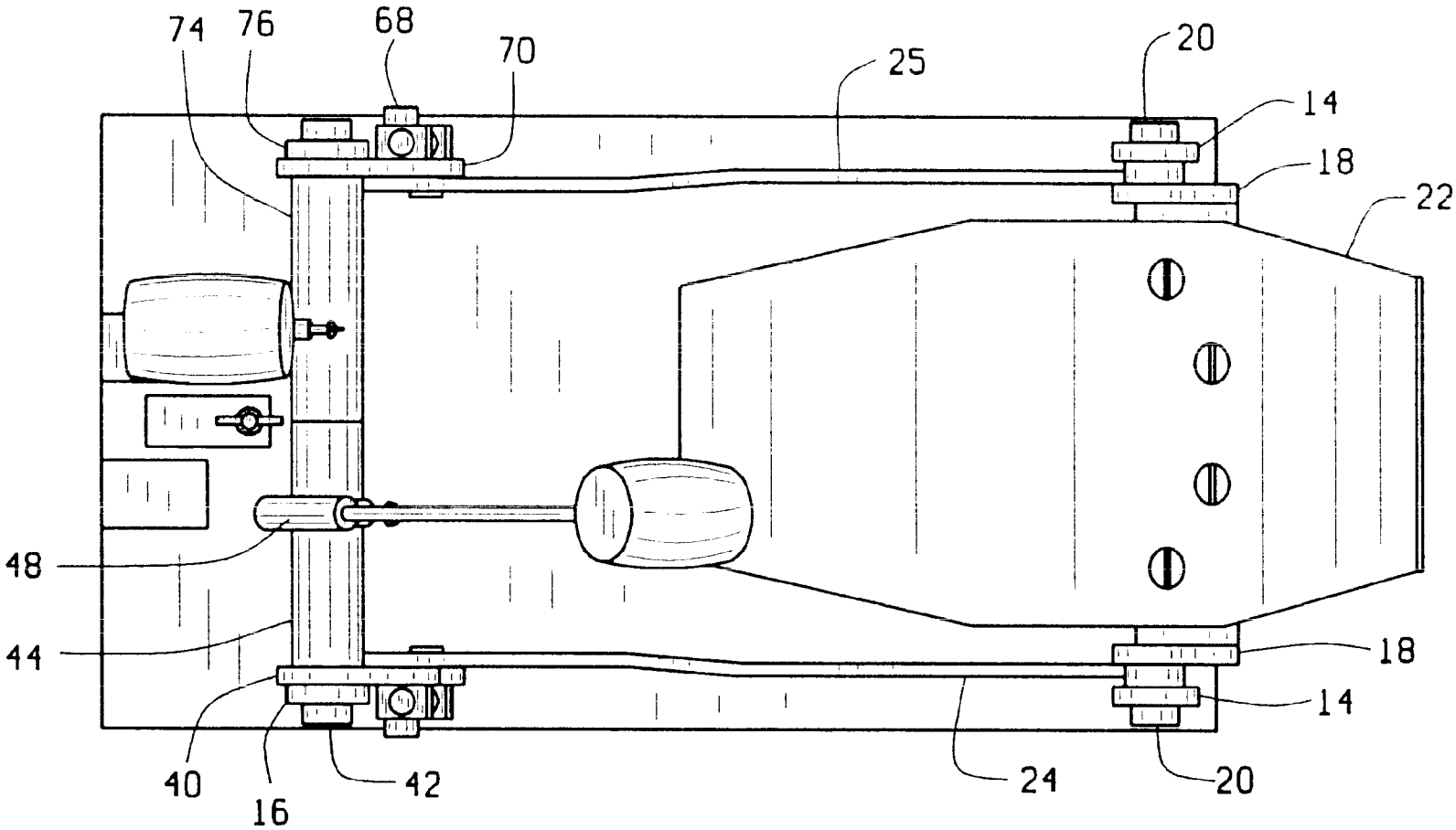
FIG. 4 is a plan view of the preferred embodiment showing the footplate in the rearward rocking position and the right beater in the forward position.

Left and right thrust arms or push rods 24 and 25 (FIGS. 1,4) are pivotally attached by two bolt assemblies 26 to the lower portions of the left and right legs 19, 19*a*, respectively, of the U-bracket 18. The left thrust arm 24 extends toward the left leg 17 of U-bracket 16 above the base plate 10 and is pivotally attached by a bolt assembly 28 to the end of a first arm 31*a* of a cam or shaped lever 30. The cam 30 has two equal length arms 31, 31*a* positioned at 90° to each other. The cam 30 is pivotally mounted at its center by a bolt assembly 32 to the inner surface of the left leg 17 of the U-bracket 16, below the thrust arm 24. The end of the second cam arm 31 is pivotally attached by a bolt assembly 34 to a connecting rod or push rod 36 that is positioned in a generally vertical direction and is threaded into a socket 33 (FIG. 2) and secured there by a lock washer and jam nut 33*a*. The socket 33 is pivotally attached by a bolt assembly 38 to one end of a flat cam or connecting arm 40. By changing the extent to which the push rod 36 is screwed into the socket 33, the distance between the cam arm 31 and the end of the connecting arm 40 can be adjusted. As will be explained in detail hereinafter, this effectively changes the length of the push rod 36 and thus changes the speed and strength of the drum beat. It also allows adjustment of the device to suit the feel and style of the drummer.

The opposite end of the connecting arm 40 is fixedly attached to a first sleeve 44 that encases and freely rotates about a shaft 46. The shaft 46 spans horizontally between the free ends of the bracket legs 17, 17*a*, and is fixedly attached to the legs 17, 17*a* by bolts 42. The sleeve 44 abuts the inner face of the left leg 17 of U-bracket 16 and extends to the midpoint of the shaft 46. Each of the axes of rotation about bolt assemblies 20, 26, 28, 32, 34, and 38, and through the center of the sleeve 44 and the shaft 46, are horizontal and parallel to the center of the bases 15*b*, 17*b* and 19*b* of the U-brackets 14, 16 and 18, respectively.

A first beater holder 48 is fixedly attached at one end along its outer surface to the outer surface of the sleeve 44. The holder 48 is positioned near the midsection of, and is perpendicular to the sleeve 44. A stem 52 of a first beater B1 fits inside the holder 48, with a head 54 of the beater B1 above the holder 48. A wing-nut setscrew fastener assembly 56, mounted at the end of the holder 48 furthest from the sleeve 44, can be tightened on the stem 52 to hold the beater B1 securely in place. The height of the head 54 of the beater B1 above the holder 48 can thereby be readily adjusted by sliding the stem 52 up or down within the sleeve 48 to the desired location and then tightening the set screw assembly 56.

The right thrust arm 25 extends toward the right leg 17*a* of U-bracket 16 above the base plate 10 and is pivotally attached by a bolt assembly 58 to the end of a first arm 61*a* of a cam or shaped lever 60 (FIG. 1). The cam 60 is identical to the cam 30 and has two equal length arms 61,61*a* positioned at 90° to each other. The center of the cam 60 is pivotally mounted by a bolt assembly 62 to the inner surface of the right leg 17*a* of the U-bracket 16, above the thrust arm 25. The end of the second cam arm 61 is pivotally attached by a bolt assembly 64 to a short push rod 66 that runs in a generally vertical direction and is threaded into a socket 67 and retained there by a lock washer and jam nut 67*a*. The socket 67 is pivotally attached by a bolt assembly 68 to one end of a flat cam or connecting arm 70. By changing the extent to which the push rod 66 is screwed into the bolt assembly 68, the distance between the cam arm 61*a* and the end of the cam 70 can be adjusted. As will be explained in detail hereinafter, this effectively changes the length of the push rod 66 and thus changes the speed and strength of the drum beat. It also allows adjustment of the device to suit the feel and style of the drummer.

The connecting arm 70 is fixedly attached to a second sleeve 74 that encases and freely rotates about the shaft 46. The sleeve 74 abuts the inner face of the right leg 17*a* of the U-bracket 16 and extends to the midpoint of the shaft 46, where it abuts the first sleeve 44. Each of the axes of rotation about the bolt assemblies 58, 62, 64, and 68, and through the center of the sleeve 74, are horizontal and parallel to the center of the bases 15*b*, 17*b* and 19*b* of the U-brackets 14, 16 and 18, respectively.

A second beater holder or retainer 78 fixedly attaches at one end along its outer surface to the outer surface of the sleeve 74. The holder 78 is positioned near the midsection of, and runs perpendicular to the sleeve 74. A beater B2 has a stem 82 that fits inside the holder 78, with a head 84 of the beater B2 above the holder 78. A wing-nut set-screw assembly 86 is mounted at the end of the holder 78 furthest from the sleeve 74, and can be tightened on the stem 82 to hold the beater B2 securely in place. The height of the beater head 84 above the holder 78 can thereby be readily adjusted by sliding the stem 82 up or down the holder 78 to the desired location and then tightening the set screw assembly 86.

The beater holders 48, 78 are tangentially mounted on the sleeves 44, 74 at 90° thereto. The holders 48, 78 are a sufficient distance from each other to provide ample clearance for the beaters B1, B2 to swing without interference. The place the beaters B1, B2 strike the drum D is determined, in part, by the length of the beater stems 52, 82 above the holders 48, 78.

The connecting arms 40, 70 extend out from the centerline of the axle or shaft 46 at a 90° angle in relation to the direction of rotation. The arms 40, 70 extend away from the drum D toward the footboard 22. The orientation of the arms 40, 70 is such that when one of the arms 40, 70 is horizontal or parallel to the base plate 10, the respective beater holder 48 or 78 is oriented in a vertical position. Therefore, the respective beaters B1, B2 also are oriented in a vertical position. The alignment is such that the outsides of the arms 40, 70 are aligned perpendicular with the side arms 19, 19*a* of the cradle 18.

In order to convert the reciprocal heel/toe motion of the user's foot onto the angular motion required to move the beaters B1, B2 into and out of engagement with the drum D, the orientation of the levers 30, 60 and the length of the push rods 36, 66 are important. As previously noted, the lever 30 has the arms 31,31*a* located at 90° to each other and the lever 60 has the arms 61, 61*a* located at 90° to each other. The levers 30, 60 are pivotally connected to the uprights 17, 17*a* at their midpoints 32, 62. However, the right lever pivot is oriented so that its vertical arm is below pivot point 62, and left lever 30 is oriented so that its vertical arm 31*a* is above pivot point 32. Hence, the levers 30, 60 are mounted so that the vertical arms 31*a*, 61*a* are directed at 180° to each other. The right push rod 66 is shorter than the left push rod 36. Also, when the levers 30, 60 are positioned such that their horizontal arms 31, 61 are generally parallel to the base plate 10 and facing rearwardly, the upright vertical arms 31*a*, 61*a* are at right angles to the horizontal arms 31, 61. The longer left connecting rod 36 pivotally connects the free end of the horizontal arm 31 to the connecting arm 40, while the shorter right connecting rod 66 pivotally connects the free end of the horizontal arm 61 to the connecting arm 70.

The left push rod 24 pivotally connects the free end of the vertical arm 31*a* to the foot pedal 22 while the right push rod 25 pivotally connects the free end of the oppositely directed vertical arm 61*a* to the foot pedal 22.

OPERATION

The present invention operates by converting the swinging action of the footboard into an action which causes the two or more beaters to consecutively strike a percussion instrument. A user places his foot upon the footboard and swings the footboard toward the percussion instrument and then away from the percussion instrument to create one swing cycle. In the current double beater embodiment shown herein, one beater strikes the percussion instrument when the user's foot swings the footboard forward, and the other beater strikes the percussion instrument when the user's foot swings the footboard away from the percussion instrument.

More specifically, as can be seen from FIG. 2, when the toe of the user drops, the footboard 22 and the U-bracket 18 swing back from the drum D. The left thrust arm 24 rotates the cam 30 clockwise, as to FIG. 2, around the bolt assembly 32. The cam 30, in turn, pulls down on the push rod 36 and the rod 36 rotates the connecting arm 40 in a clockwise direction. The connecting arm 40 then rotates the sleeve 44 clockwise about the shaft 46, and thereby directs the beater holder 48 and the beater B1 away from the drum D.

Figure 3:
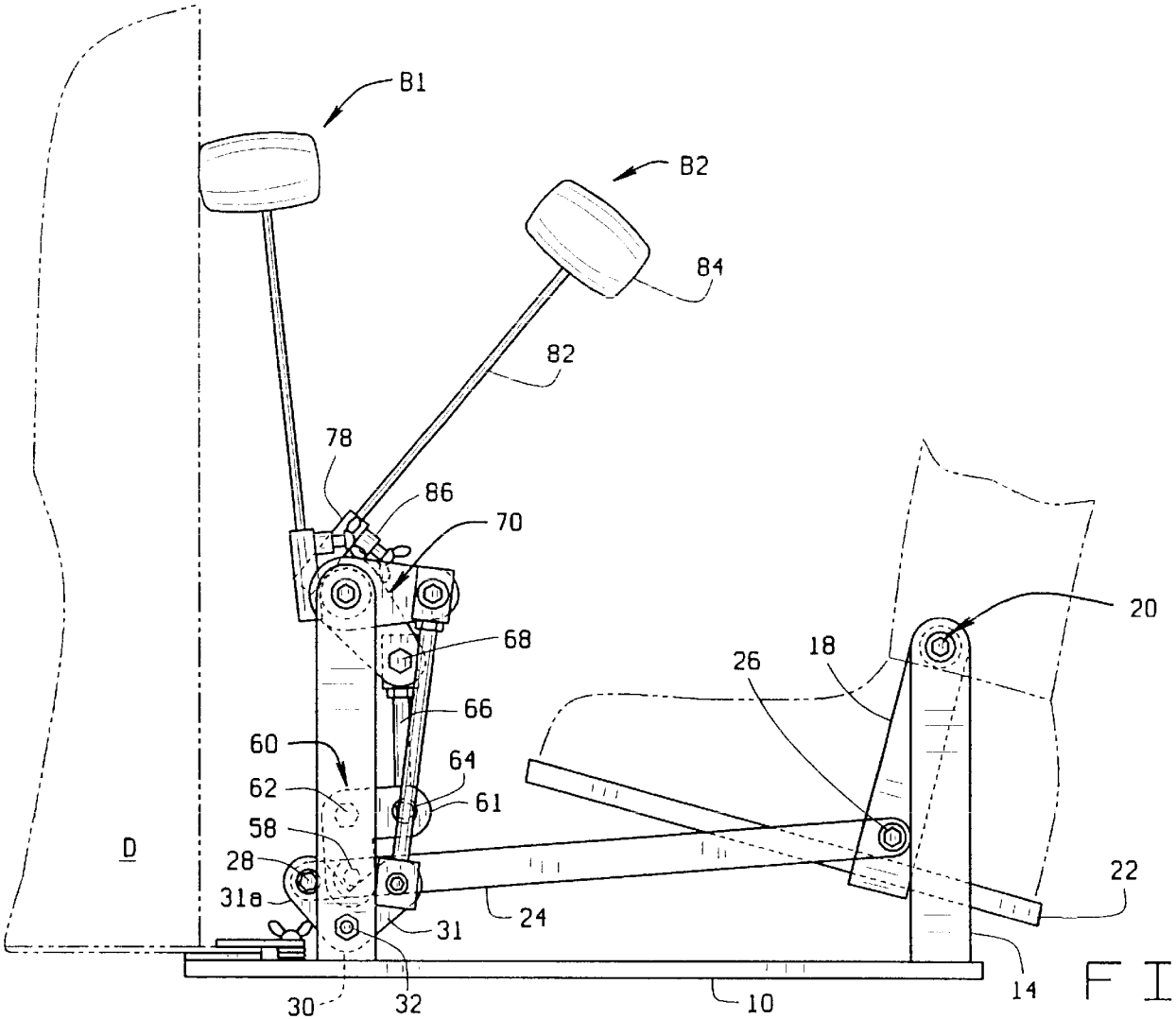
FIG. 3 is a side elevation view of the preferred embodiment showing the foot plate in the forward rocking position and the left beater striking the drum head.

In contrast, in FIG. 3 it can be seen that as the toe of the user rises and the heel drops, the footboard 22 and the U-bracket 18 swing toward the drum D. The thrust arm 24 then rotates the cam 30 counterclockwise, as to FIG. 3, around the bolt assembly 32. The movement of the cam 30, in turn, raises, the push rod 36 and rotates the connecting arm 40 in a counterclockwise direction. The arm 40 then rotates the sleeve 44 counterclockwise about the shaft 46, and thereby directs the holder 48 and the beater B1 toward and against the drum D to produce a drum beat.

Similarly, as footboard 22 and U-bracket 18 swing back from the drum D (FIG. 2), the right thrust arm 25 rotates the cam 60 counterclockwise around the bolt assembly 62. The cam 60, in turn, pushes up on the push rod 66 which rotates the connecting arm 70 counterclockwise. The arm 70, in turn, rotates the sleeve 74 counterclockwise about the shaft 46, and thereby directs the beater holder 78 and the beater B2 toward and against drum D to produce a drum beat.

In contrast, in FIG. 3 it can be seen that as the footboard 22 and U-bracket 18 swing toward the drum D, the thrust arm 25 rotates the cam 60 clockwise, as to FIG. 3, around the bolt assembly 62. The cam 60, in turn, pulls the rod 66 downwardly to rotate the arm 70 in a clockwise direction. The arm 70 rotates the sleeve 74 clockwise about the shaft 46, and thereby directs the holder 78 and beater B2 away from the drum D.

Both of the beaters B1 and B2 operate upon the same swinging motion of the footboard 22 and U-bracket 18. Hence, when the footboard 22 swings away from the drum D, the beater B1 moves away from the drum D, while the beater B2 moves toward, and may ultimately strike, the drum D. When the footboard 22 swings toward the drum D, the beater B1 moves toward, and may ultimately strike, the drum D, while the beater B2 moves away from the drum D.

The distance from the top 23 of the footboard 22 to the bolt assembly 20 equals the approximate distance from the bottom of the foot to the shin for an average person. This replicates the natural rotation of an average person's ankle and thereby provides ergonomic functionality while minimizing fatigue.

The present invention, therefore, enables the user to easily, controllably, and rapidly beat a percussion instrument with two beaters by merely moving the toe and heel of the user alternatively downwardly on the footboard 22, thus swinging the footboard 22 forward and backward with a foot. Not only is the foot swing action ergonomic, it provides the user with great versatility in playing percussion instruments. For example, the user can control the tempo of the drumbeat by simply maintaining a constant swing duration between each beat. By varying the swing speed between each beat, the user can control the volume of each beat. Furthermore, by varying the duration of swing speed between each beat, either by timing the foot motion or by adjustment of the lengths of the push rods 36 and 66, the user can implement a multitude of differing beat patterns. This invention causes the beaters B1, B2 to move in alternate and contrary motion, relative to each other, with each toe/heel angle of the foot.

The purpose of the push rod 36, 66 adjustments is twofold. The first purpose is to provide a variable stroke length for the beaters B1, B2 (making the rod longer, makes the travel distance between the drumhead D and the front surface of the beater shorter, and the stroke slightly faster). However, making the rod shorter will increase the travel distance between the drumhead D and the front surface of the beater B1, B2. This makes the stroke slightly slower, but potentially stronger.

Another factor of this arrangement is that the adjustment of one rod (calibrating the leverage of one whole side), effects the front/back position of the other side. The position of the backward stopping point is determined by the position of the other beater touching the drumhead. It is possible to adjust each side so that the toe side has a different length stroke than the heel side. This is needed to make the pedal suitable to various playing styles and levels of development.

The second purpose of these adjustments is to adjust the angle of the footboard 22. Shortening the rod 36 will also have the effect of raising the toe portion of the footboard 22 at the time that the beater B1 strikes the head D. Shortening the rod 66 has the effect of raising the heel portion of the footboard 22 at the time that beater B2 strikes the head D.

Also, lowering the stem 52 of the beater B1 with the wing nut 56 shortens the stroke length, and of course, raising the shaft 52 of the beater B1 with the wing nut 56 increases the stroke length. Naturally, the same thing applies to the beater B2.

The design of this pedal obtains its speed and smoothness because of the reciprocal motion of the beaters B1, B2. Refinement of this relationship to fit the player's style has a major effect on the "feel" of the pedal 22. They are both necessary to balance the angle of the footboard 22 and at the same time calibrate the stroke length. Each drummer will have an individual preference, and it will change with technique and performance requirement. In operation, the swing action of the pedal 22 and cradle 18 causes a convex arch with respect to the pivot above the bottom of the foot, thus allowing the toe/heel alternate action required to activate the strokes, but with an effort slightly greater than that required to move the user's foot in the air with his legs crossed. Traditional pedals are designed to cause a concave arch with respect to a pivot below the bottom of the foot, or at the back of the foot, that causes the ankle of the musician itself to rotate around the pivot below the bottom of the foot, like rolling your foot over a round log or baseball bat. This small difference in the type of motion is significant.

Variations on the basic apparatus are available. For example, U-brackets 14, 16 and 18 can be formed by machining, forging, casting or any of a variety of other means, or can be made of materials other than steel, and their shape can vary to include additional structural members, or be formed as webbing for lighter weight. The bolt assemblies 26, 28, 32, 34, 38, 58, 62, 64, and 68 can be replaced with various assemblies that include pivot pins, bearings, bushings, or any other means that provide ready rotation. Bushings, bearings and/or washers can be placed between, in or under, any or all of the rotating members. The cams 30, 40, 60 and 70, and the rods 36 and 66, may assume a variety of shapes so long as they each properly perform the functions described in this application.

While the embodiment shown herein utilizes cams and rods to translate the swinging movement of the footboard into the movement of the beaters against a percussion instrument, it is understood that alternative embodiments of the present invention are also capable of such translation of movement. Such alternative embodiments would include, without limitation, replacement of the cams and rods of the current embodiment with various arrangements of springs, gears, pulleys, cables, or electromechanical devices such as servos or stepper motors. Additionally, while the current embodiment discloses the use of metals for many of the components of the invention, is it clear that the use of alternate materials such as high strength plastic, wood, or any other similar material could also be used. Numerous other apparatuses, such as screws, clamps, levers, braces, ropes and wires, in addition to the fastener 12, can hold the swing double beater S to a desired instrument to be played. The invention can also be readily configured to play only one beater, or more than two. Other devices, such as clamps, peg and holes, springs, and pressure plates can perform the same function in the invention as the set screw assemblies 56 and 86.

Although two beaters are described in the embodiment of the invention described herein, the invention may be readily adapted to activate more than two beaters. By simply adding more beaters to the device and adapting the mechanism which translates the swinging of the footboard into movement of the beaters, three or more beaters can be forced to strike a percussion instrument at various points of the swinging motion of the footboard.

As various other changes could be made in the above constructions without departing from the scope of the invention, it is intended that all matter contained in the above description or shown in the accompanying drawings shall be interpreted as illustrative and not in a limiting sense.

What is claimed is:

1. A percussion beater apparatus comprising:

a swinging footboard;

at least two beaters;

a base having a front end and a rear end wherein the swinging footboard is mounted above and toward the rear of said base and is adapted to be engaged by a user's foot;

a beater mechanism mounted toward the front end of said base, the beater mechanism alternately moving the at least two beaters toward and away from a playing surface of a percussion instrument;

a plurality of pushrods connecting the swinging footboard to the beater mechanism and responsive to movement of the swinging footboard, wherein each of the at least two beaters strikes a percussion instrument once for each direction of a swing cycle of the swinging footboard, and wherein each of the at least two beaters strike the percussion instrument at one of either a different interval or a reciprocal interval;

a shaft, horizontally positioned above the base at the front of the apparatus, about which the at least two beaters rotate;

at least two sleeves encircling the shaft, wherein the at least two beaters are attached to the at least two sleeves and thereby rotate about the shaft;

a receptacle attached to each of the at least two sleeves, wherein the beater stem from one of the at least two beaters fits inside the receptacle, each receptacle having a set screw securing the beater stem at a desired orientation and position within the receptacle;

a first pair of vertical support members at the front of the apparatus that supports the shaft above the base;

a second pair of vertical support members at the rear of the apparatus from which the swinging footboard swings, wherein the height from the top of the swinging footboard to a pivot point of the swinging footboard is approximately equal to the height from the bottom of an average person's foot to that person's shin; and a series of cams and rods that connect the sleeves to the swinging footboard in order to control the rotation of the at least two beaters wherein the separation distance between components along one or more of the rods is capable of being shortened or lengthened so as to enable adjustment between the rotational position of the beaters in relation to the rotational position of the footboard.

2. The percussion beater apparatus of claim 1, and further comprising a pair of straps rotationally connecting the footboard to the second vertical supports.

3. The percussion beater apparatus of claim 2, wherein:

a. the beaters and the footboard are all configured to rotate in arcs directed between the front and rear of the apparatus;

b. the shaft is mounted between the first pair of vertical support members and perpendicular to the arcs of rotation for the beaters and the footboard;

c. the rear vertical support members form a first U-bracket, attached at the bottom to the base, and oriented parallel to the horizontal shaft;

d. the front vertical support members form a second U-bracket, attached at the bottom to the base, and oriented parallel to the horizontal shaft;

e. the pair of straps supporting the footboard form a third U-bracket, smaller than the first U-bracket;

f. the third U-bracket is mounted within the first U-bracket, such that the third U-bracket swings freely from and between the vertical legs of the first U-bracket;

g. whereby a forward swing of the footboard rotates a first beater toward and into engagement with the playing surface of the percussion instrument and simultaneously rotates a second beater away from the playing surface of the percussion instrument; and a rearward swing of the footboard rotates the first beater away from the playing surface of the percussion instrument and simultaneously rotates the second beater toward and into engagement with the playing surface of the percussion instrument.

4. The percussion beater apparatus of claim 3, and further comprising a series of removable fasteners that rigidly attach the first and second vertical support members to the base, wherein the first and second vertical support members are capable of being separated from the base by loosening or removing the fasteners in order to reduce the encumbrance of the apparatus for transport or storage.

5. The apparatus of claim 4 wherein the fasteners are machine screws.

6. The percussion beater apparatus according to claim 5, and further comprising a clamping device to fixedly attach said apparatus to a desired percussion instrument.

7. A percussion beater apparatus adapted to impart strokes of beaters to a percussion instrument comprising:

a base having front and rear ends;

a first set of laterally spaced vertical support members adjacent to the front end of the base and a second set of laterally spaced vertical support members at the rear end of the base;

a footboard swingably mounted between the second set of vertical support members and above the rear of said base, said board adapted to be engaged by a user's foot;

a shaft positioned between the free ends of the first set of vertical support members;

sleeves rotatably positioned on the shaft;

beaters attached to the sleeves and rotatable with the sleeves; and two actuator assemblies connecting the swinging footboard and the sleeves and responsive to swinging movement of the footboard to alternately engage and disengage the beaters with the percussion instrument, wherein the two actuator assemblies are located on the sides of the footboard and between the first set of vertical support members, each of the two actuator assemblies comprising a lever having a vertical and a horizontal arm positioned at right angles to each other, the lever being pivoted to one of the vertical supports where the arms join, a first push rod pivotally connecting the swinging footboard to one of the lever arms, a second push rod pivotally connecting the second end of the lever to a connecting arm fixed to one of the sleeves whereby rotation of the connecting arm rotates the sleeve.

8. The beater apparatus of claim 7 wherein the second push rods are adjustable in length.

9. The beater apparatus of claim 7 wherein the levers on each side are oriented with the arms positioned in opposite directions such that the vertical arm on one side depends downwardly from the horizontal arm and the vertical arm on the other side depends upwardly from the horizontal arm.

10. The percussion beater apparatus of claim 7 wherein a series of removable fasteners rigidly attach the first and second vertical support members to the base, wherein the first and second vertical support members are capable of being separated from the base by removing the fasteners to reduce the size of the apparatus for transport.

11. The percussion beater apparatus of claim 7 wherein the beaters each have a head for engaging the percussion instrument and a stem attached to the head, receptacles attached to the sleeves, the beater stems being adjustably positioned in the receptacles, whereby each beater head is capable of being adjustably positioned at a desired orientation and position relative to the percussion instrument and the sleeve which activates it.

* * * * *